US006405937B1

(12) United States Patent
Stukenberg

(10) Patent No.: US 6,405,937 B1
(45) Date of Patent: Jun. 18, 2002

(54) SYSTEM OF MODULAR ROCKS WITH WATERFALL

(76) Inventor: Daniel R. Stukenberg, W1786 Sunset Dr., Campbellsport, WI (US) 53010

( * ) Notice: Subject to any disclaimer, the term of this patent is extended or adjusted under 35 U.S.C. 154(b) by 0 days.

(21) Appl. No.: 09/498,735

(22) Filed: Feb. 7, 2000

(51) Int. Cl.[7] ..... B05B 17/04; B05B 17/08

(52) U.S. Cl. ..... 239/12; 239/16; 239/17; 239/20; 239/23; 239/211; 446/85; 446/491

(58) Field of Search ..... 239/12, 16, 17, 239/20, 23, 211; 52/604, 606, 503, 561; 446/85, 491

(56) References Cited

U.S. PATENT DOCUMENTS

| | | | | | |
|---|---|---|---|---|---|
| 945,859 | A | * | 1/1910 | Neuberger | 52/503 |
| 3,409,223 | A | * | 11/1968 | Gosh | 239/17 |
| 3,901,439 | A | | 8/1975 | Willis | |
| 4,318,945 | A | * | 3/1982 | Goldman et al. | 428/15 |
| 4,385,088 | A | | 5/1983 | Baskin | |
| 4,819,874 | A | * | 4/1989 | Geiger | 239/23 |
| 4,836,142 | A | | 6/1989 | Duback | |
| 5,083,528 | A | | 1/1992 | Strong | |
| 5,112,263 | A | * | 5/1992 | Penillard et al. | 446/85 X |
| 5,167,368 | A | | 12/1992 | Nash | |
| 5,233,806 | A | * | 8/1993 | Hightwoer et al. | 52/561 |
| 5,443,774 | A | | 8/1995 | Kluh et al. | |
| 5,501,178 | A | | 3/1996 | Kemp | |
| 5,543,100 | A | | 8/1996 | Kluh et al. | |
| 5,735,723 | A | * | 4/1998 | von Oppen | 446/85 |
| 5,826,373 | A | * | 10/1998 | Mrdjenovich | 47/33 |
| 5,827,105 | A | * | 10/1998 | Felgenhauer et al. | 446/85 X |
| 6,033,744 | A | * | 3/2000 | Bright, Sr. | 428/15 |
| 6,149,991 | A | * | 11/2000 | Okuda | 239/20 X |

OTHER PUBLICATIONS

Brochure "Waterfalls of Nature" Nov. 1999.

* cited by examiner

*Primary Examiner*—Robin O. Evans
(74) *Attorney, Agent, or Firm*—Donald Cayen

(57) ABSTRACT

A system of modular artificial rocks provides aesthetic appeal to a landscape. The system comprises at least two rocks, one stacked on the other and interlocked to each other, as by a tongue and groove arrangement. The rocks have respective back ends that overhang. The back ends of all but the bottom rock of a stack are supported off the ground. In a modified embodiment, the back ends of the rocks align in vertical planes. There may be one back end, in which case the rocks can be placed flush against a fence or a building wall. In another embodiment, there are two back ends. Two or more stacks of modular rocks are placed with their back ends in flat facing contact. For example, the back ends of the rocks of each of three stacks may subtend an angle of 120 degrees. A waterfall can be incorporated into any of the stacks. The bottom rock of a stack has a depression that acts as a reservoir. Water is pumped to the top of the top rock of the stack, from where it flows back to the reservoir.

20 Claims, 8 Drawing Sheets

SYSTEM OF MODULAR ROCKS WITH WATERFALL

BACKGROUND OF THE INVENTION

This invention pertains to landscaping, and more particularly to apparatus that provides natural appearing decorative scenery for indoor and outdoor applications.

DESCRIPTION OF THE PRIOR ART

Various types of products have been developed to enhance the decor of gardens, courtyards, lawns, and similar areas. A particularly desirable landscape feature is large decorative rocks. Because natural rocks of a size sufficient to be aesthetically pleasing in outdoor settings are too difficult to handle, it is known to produce artificial rocks. U.S. Pat. Nos. 4,385,088; 5,443,774; 5,543,100; and 5,826,373 show typical large decorative artificial rocks.

A disadvantage of the prior artificial rocks as described in the foregoing patents is that they all appear and function as individual pieces. There is no way to arrange two or more of the individual rocks into a natural looking collection or grouping. Although individual rocks are attractive when used singly, they lose their appeal when merely placed side by side. The prior rocks are also unable to be stacked on top of each other in a manner that looks natural and attractive.

It is also well known to incorporate falling water into landscapes, both indoors and outdoors. For example, the Waterfalls Of Nature Company of Riverdale, N.Y., markets fiberglass waterfalls and ponds. The falling water is appealing to both a person's eyes and ears. However, prior decorative waterfalls have been rather limited in size and design. U.S. Pat. Nos. 3,901,439 and 5,167,368 describe self-contained systems of artificial waterfalls, but neither of the foregoing systems is entirely natural looking. In addition, none of the patents mentioned earlier pertaining to decorative artificial rocks is suitable for use with falling water.

Thus, a need exists for improvements in landscape products that combine multiple natural looking rocks with falling water.

SUMMARY OF THE INVENTION

In accordance with the present invention, a system of decorative rocks is provided that is more versatile and attractive than prior artificial rocks. This is accomplished by apparatus that includes a plurality of artificial rock modules that are both stackable in a manner that presents a pleasing appearance and that are suitable with falling water.

The rock modules are hollow, and they have relatively thin walls. The outer surfaces of the walls are contoured and colored to give the appearance of natural rocks.

A system of decorative rocks comprises at least two rocks. One rock is stacked upon another such that there is always a bottom rock and a top rock in a stack. The bottom rock has a lower surface and an upper surface. The top rock has a lower surface that is received in and interfits with the bottom rock upper surface. Both rocks have contoured side walls. There may be one or more intermediate rocks between the top and bottom rocks. The intermediate rocks have upper and lower surfaces that interfit with the lower surface of the top rock and upper surface of the bottom rock, respectively. In keeping with one aspect of the invention, the bottom and intermediate rocks are identical.

In some instances, it is desirable that the rocks of a stack interlock. For that purpose, the upper surfaces of the bottom and intermediate rocks are formed with one or more grooves. Mating tongues depend from the lower surface of the adjoining rock. In that manner, the rocks interlock as well as interfit against movement after they are stacked.

According to another aspect of the invention, the top rock has a back end that overhangs the back end of the underlying rock. The back end of the overhanging rock is supported in any convenient way. Preferred supports are pails between the ground and the lower surface of the top rock overhanging end. If three rocks, for example, are used, the intermediate rock overhangs the bottom rock, and the top rock overhangs the intermediate rock. Relatively small pails can be used to support the back end of the intermediate rock, and larger drums can be used to support the back end of the top rock. The pails and drums are covered with dirt or the like, which in turn is covered with decorative material such as shredded bark, plants, or sod. In some instances, overhanging rocks are located on the slope of a natural hill. In that situation, the hill is dug out just enough to support the back ends of the overhanging rocks, and no secondary supports such as pails or drums are needed.

In a modified embodiment of the invention, the rocks are configured such that when stacked upon each other there are no overhanging ends. Rather, the stacked rocks have respective back ends that are straight and vertically aligned with each other. Rocks with aligned back ends are suitable for placing against a fence or wall of a building. The back walls of two stacks of aligned rocks can be placed against each other to create a free standing system that presents substantially the same appearance from all sides.

In a further modified embodiment, each rock has two vertical back ends. The back ends of the rocks of a stack align. The back ends can subtend any desired angle. Particularly desired angles are 90 degrees and 120 degrees. Aligned rocks with back ends at 90 degrees to each other fit into an interior corner of a fence or building. The back ends of three stacks of aligned rocks with 120 degrees between the back ends can be placed against each other to create a free standing system.

Further in accordance with the present invention, the modular rocks are designed to include realistic waterfalls. The bottom rock of a stack has a water reservoir built into it. Preferably, the reservoir is in the shape of a depression in the upper surface. A pump in the depression feeds water via a tube to a hole in the side wall of the top rock of the stack. From the hole, the water flows over a drip edge on the top rock to the bottom rock. If there is an intermediate rock in the stack, it preferably has a depression that catches the water from the top rock and that overflows to the bottom rock depression. In some instances, the reservoir for the waterfall may be in the ground rather than in the bottom rock.

In a system of multiple stacks of rocks, each stack can have its own waterfall. A pipe connects the reservoirs to each other. In that manner, the water level is the same in all the reservoirs.

The method and apparatus of the invention, using lightweight interfitting modular rocks, thus presents a very attractive and versatile decorative landscape system. Waterfalls are includeable with the rocks, even though the system may have more than one stack and each stack may have more than two rocks.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 2:
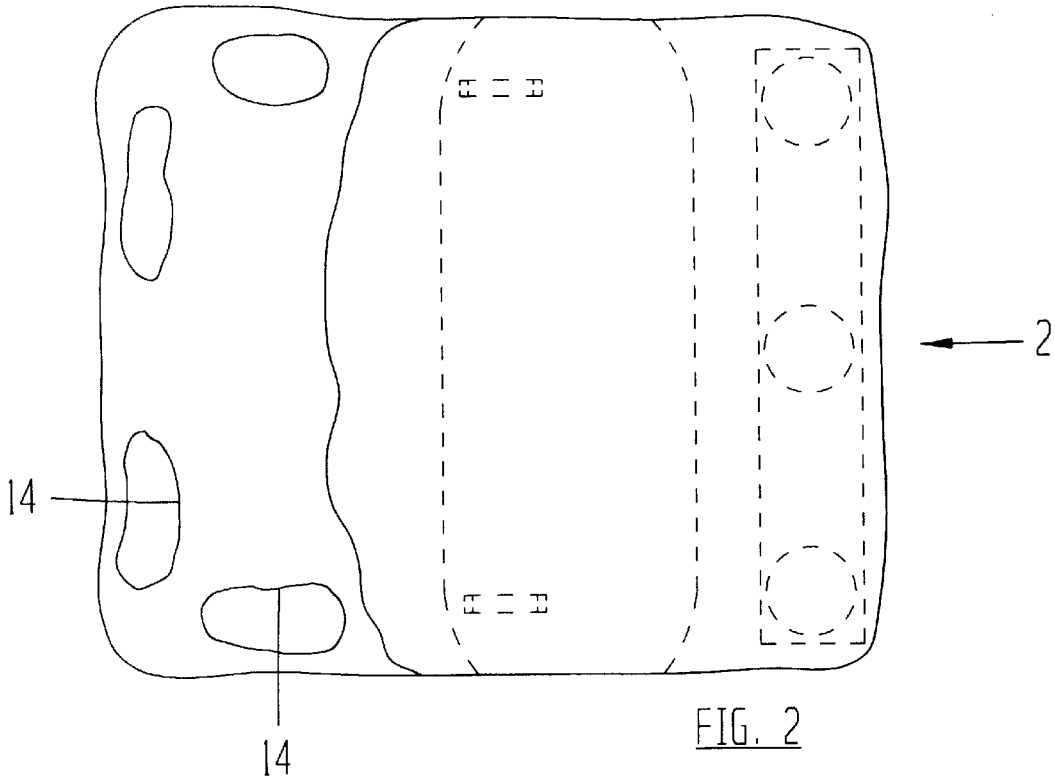
FIG. 2 is a top view of FIG. 1.
Figure 1:
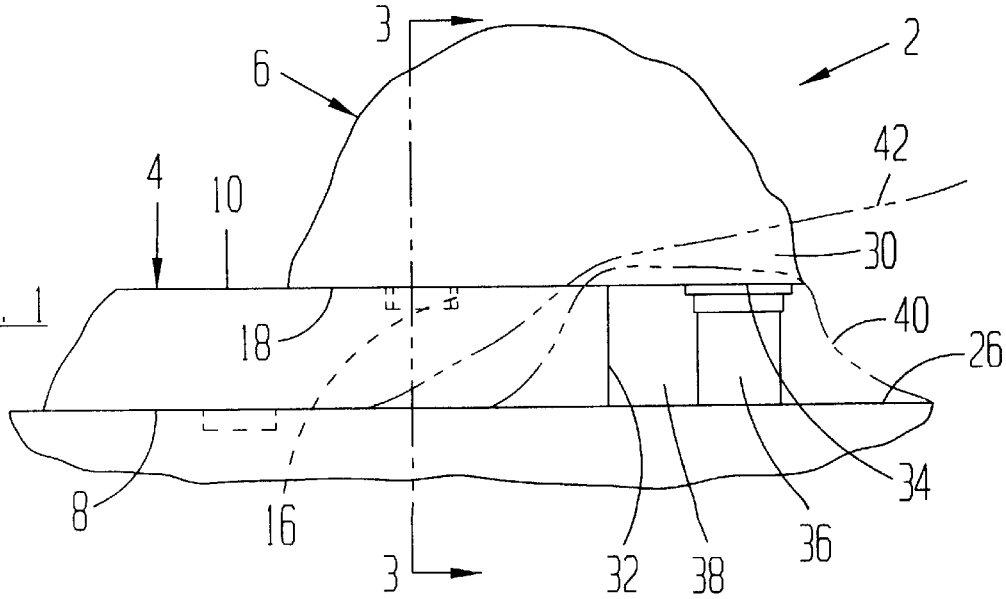
FIG. 1 is a side view of a system of modular overhanging rocks according to the present invention.
Figure 3:
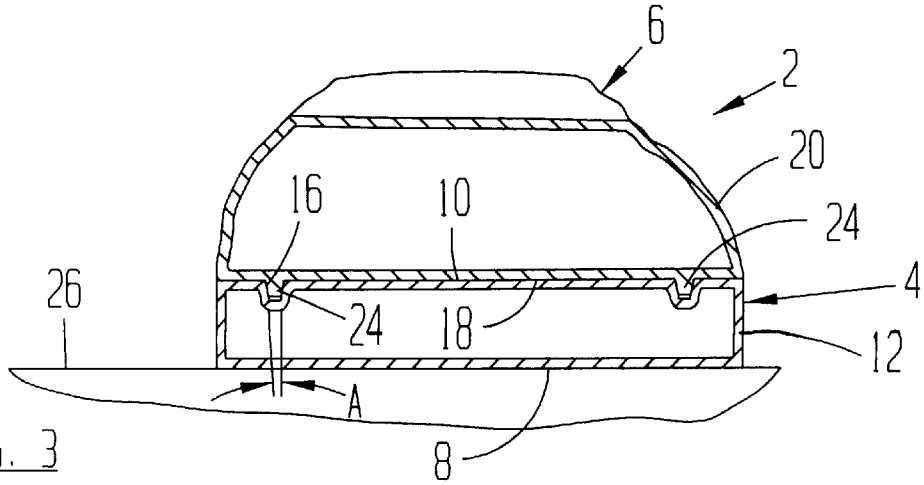
FIG. 3 is a cross-sectional view taken along line 3—3 of FIG. 1.

Referring first to FIGS. 1–3, a system 2 of overhanging modular rocks is illustrated that includes the present invention. The particular system 2 shown has two modular rocks, a bottom rock 4 and a top rock 6. The particular shapes of the rocks 4 and 6 shown are merely representative of a wide variety of shapes and contours in which the rocks can be made.

Both rocks 4 and 6 are hollow. They have relatively thin walls compared with their overall size. The rocks can be made from a variety of materials, in any suitable size and color, and by any suitable process. For example, the manufacturing methods described in U.S. Pat. Nos. 4,668,451; 4,940,558; or 5,435,949 may be used. Another satisfactory method is the gunnite process as practiced by Cost Of Wisconsin, Inc. of Germantown, Wis.

The bottom rock 4 has a lower surface 8 and an upper surface 10. Both the lower surface 8 and the upper surface 10 can have a generally convex or concave shape. As illustrated, both the upper surface and the lower surface are generally flat. The side wall of the bottom rock between the lower and upper surfaces 8 and 10, respectively, is represented generally at reference numeral 12. The bottom rock may have any desired height between the upper and lower surfaces, as well as any length and width. A satisfactory height for the bottom rock is approximately 16 inches. In the upper surface of the bottom rock are one or more deep pockets 14. The pockets 14 may be irregularly shaped to simulate random openings in natural rocks. A pair of grooves 16 are formed in the bottom rock upper surface. Each groove 16 has facing sides that converge downwardly toward the rock lower surface 8 at an included angle A. An angle A of between approximately 10 degrees and 20 degrees is satisfactory.

The top rock 6 has a lower surface 18 and a contoured side wall 20. The top rock lower surface 18 is shaped to be received in and to interfit with the upper surface 10 of the bottom rock 4. For example, the top rock lower surface may be generally convex, and the bottom rock upper surface may be generally concave. As illustrated, the top rock lower surface is flat. Depending from the lower surface 18 of the top rock are a pair of tongues 24. The tongues 24 are sized, shaped, and located to mate with the grooves 16 in the bottom rock upper surface 10.

The decorative system 2 is used by placing the bottom rock 4 on the ground 26 in any desired location. The top rock 6 is stacked on the bottom rock, with the top rock lower surface 18 received in and interfitting with the bottom rock upper surface 10. Simultaneously, the top rock tongues 24 mate with the bottom rock grooves 16. The rocks are so dimensioned that the back end 30 of the top rock overhangs the back end 32 of the bottom rock. To support the back end 30 of the top rock, supports are used between it and the ground 26. A preferred support is a long plate 34, such as a piece of plywood, under the top rock. In turn, a number of posts 36 support the plywood 34. I have found that five gallon buckets filled with sand or gravel work very well as the posts 36. The exposed area 38 between the ground and the top rock near its back end 30 is covered with landscape material such as shredded bark, decorative stone, or sod as is indicated by phantom line 40. When the landscaping material 40 is in place and decorative plants are planted in the pockets 14, the system 2 presents a very attractive and natural looking rock formation.

In some instances, the system 2 can be located on ground that is sloped, such as is represented by reference numeral 42. In that case, the slope 42 is dug out to directly support the back end 30 of the top rock 6. No extra supports are then required. Any space between the rocks and the natural slope is filled in and covered with suitable ground material.

Figure 6:
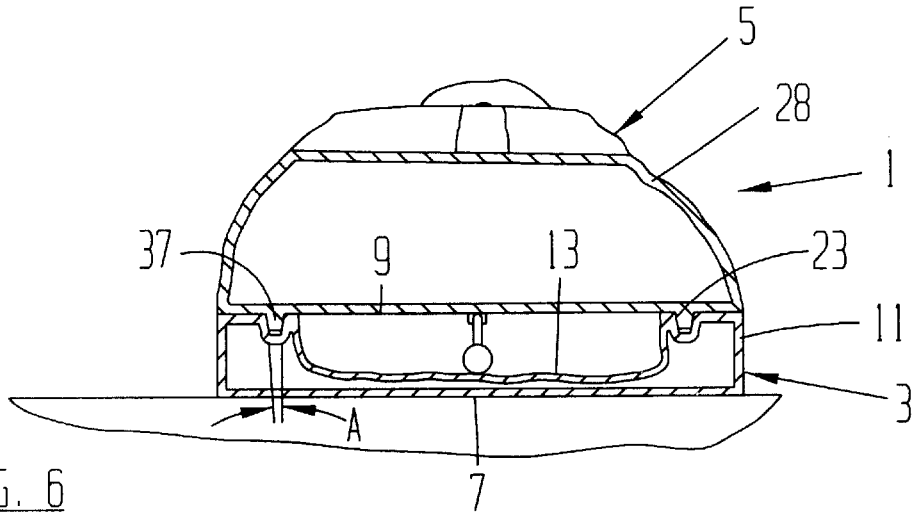
FIG. 6 is a cross-sectional view taken along line 6—6 of FIG. 4.
Figure 5:
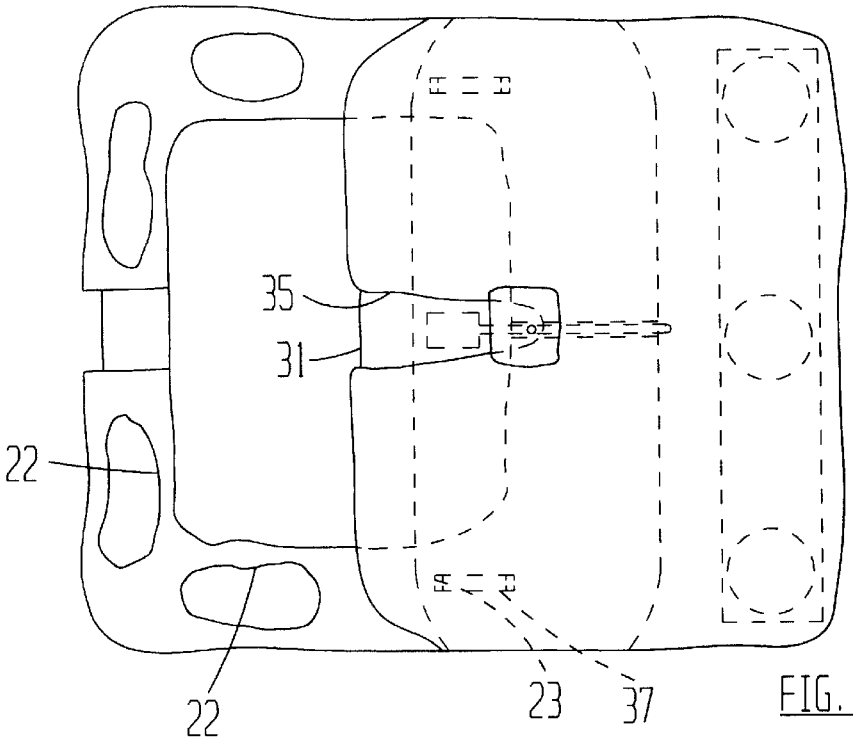
FIG. 5 is a top view of FIG. 4.
Figure 4:
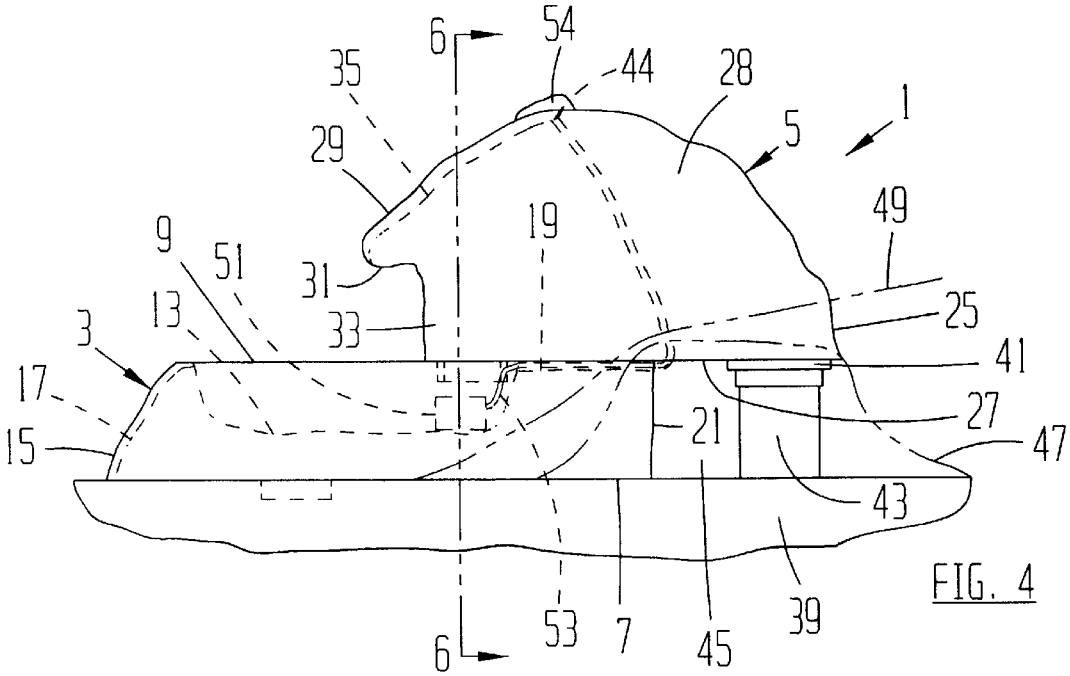
FIG. 4 is a side view of a system of overhanging rocks with a waterfall.

Further in accordance with the present invention, the system of modular rocks can include a waterfall. Turning to FIGS. 4–6, a system 1 has a bottom rock 3 and an overhanging top rock 5. The bottom rock 3 has a lower surface 7, an upper surface 9, and a contoured side wall 11. The bottom rock lower surface 7 and upper surface 9 are depicted as being flat. However, it will be understood that convex-concave shapes are also within the scope of the invention. The bottom rock has a large depression 13 in the upper surface 9 near the front end 15. There preferably is a shallow channel 17 in the front end 15 between the depression 13 and the lower surface 7. In addition, there is a slot 19 in the upper surface between the depression and the rock back end 21. Also in the upper surface are plant pockets 22. There are a pair of tapered grooves 23 in the bottom rock upper surface.

The top rock 5 has a lower surface 27 that interfits with the bottom rock upper surface 9. The front side 29 of the top rock side wall 28 has a drip edge 31 and an undercut 33. A shallow channel 35 is in the front side 29 of the side wall between a hole 44 near the top of the rock side wall and the drip edge 31. A pair of tongues 37 depend from the top rock lower surface. The tongues 37 are sized, shaped, and located to mate with the grooves 23 in the bottom rock 3.

The bottom rock 3 is placed in a desired location on the ground 39. The top rock 5 is stacked on the bottom rock, with the top rock lower surface 27 interfitting with the bottom rock upper surface 9, and the top rock tongues 37 mating with the bottom rock grooves 23. The back end 25 of the top rock overhangs the back end 21 of the bottom rock. A long plate 41 and a series of posts 43, such as buckets filled with sand or gravel, support the back end 25 of the top rock. Decorative material 47 is used to fill the space 45 between the top rock and the ground 39. Alternately, the system 1 can be installed in a natural slope 49, which is dug out to receive the back ends 21 and 25 of the bottom and top rocks, respectively.

A small water pump 51 is placed in the bottom rock depression 13. A tube 53 is connected to the pump 51 and is placed in the bottom rock slot 19. The tube 53 passes through the top rock and terminates in the hole 44 at the top of the top rock side wall 28. To further enhance the appearance of the system 1, a cap 54 of natural or artificial rock is placed over the top rock hole 44. The bottom rock depression is filled with water to act as a reservoir. Operating the pump causes water to flow through the tube and out the top rock hole. The water flows downwardly along the top rock channel 35 to the drip edge 31. From the drip edge, the water falls past the undercut 33 back into the depression 13 in the bottom rock 3. The system thus adds a very natural looking and aesthetically pleasing waterfall to a landscape.

Figure 9:
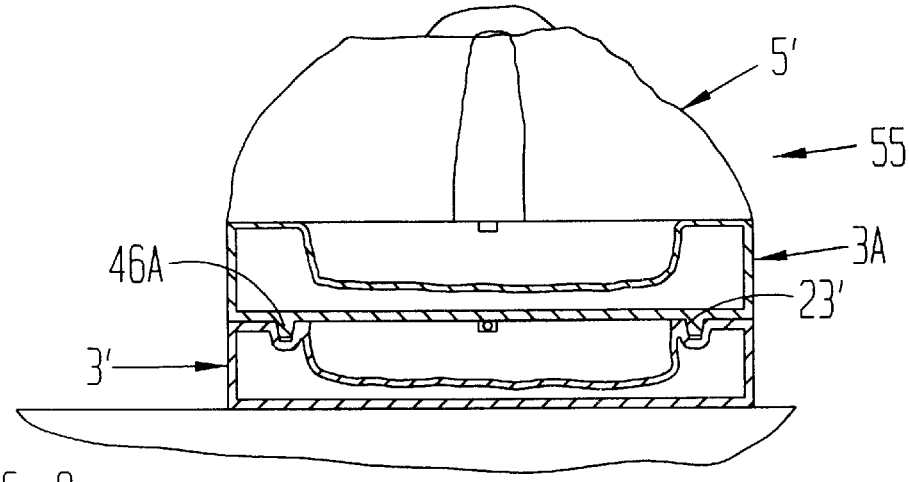
FIG. 9 is a cross-sectional view taken along line 9—9 of FIG. 7.
Figure 8:
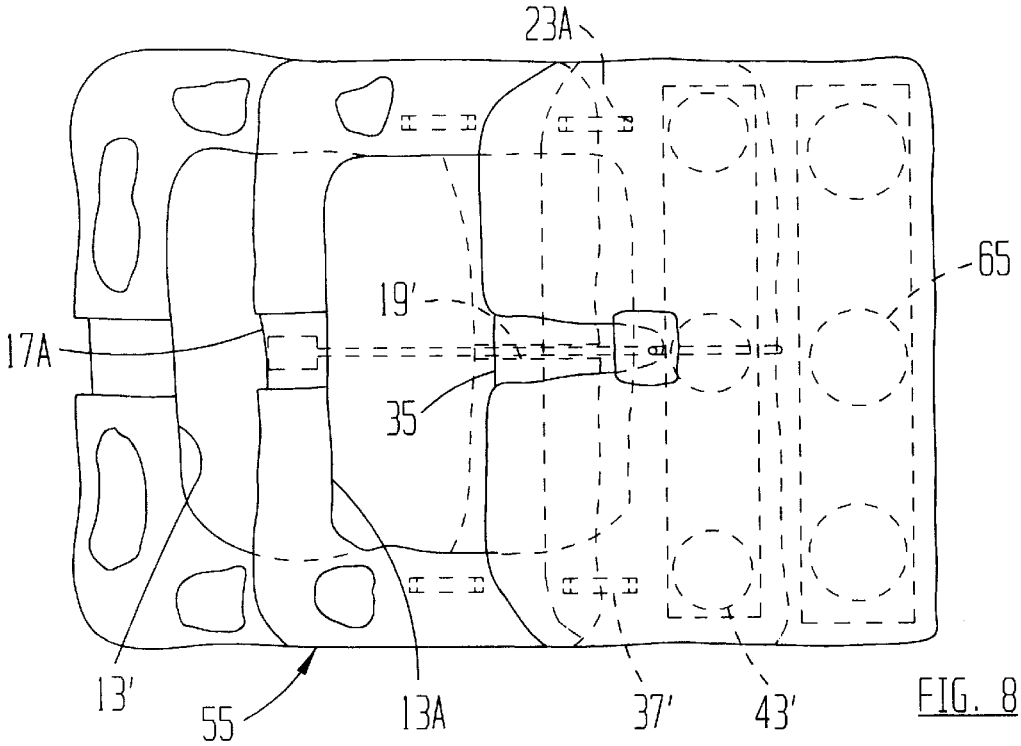
FIG. 8 is a top view of FIG. 7.
Figure 7:
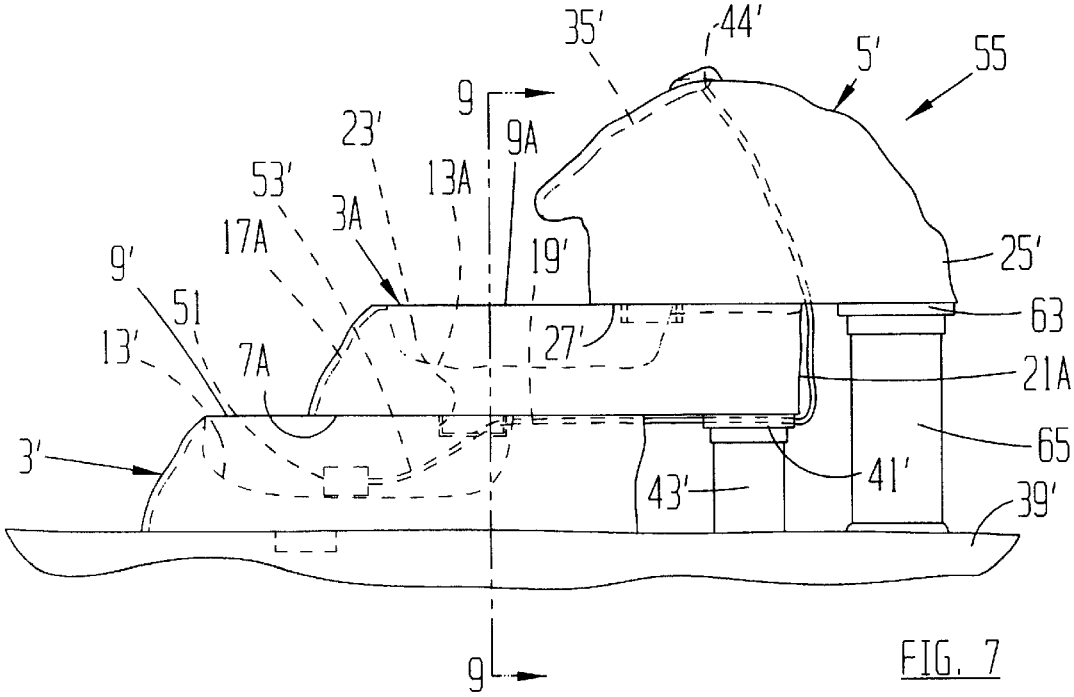
FIG. 7 is a side view of a system of three overhanging modular rocks according to the present invention.

It is a feature of the system of modular decorative rocks that more than two rocks can be stacked on top of each other. Looking at FIGS. 7–9, a system 55 has three modular rocks: a bottom rock 3' and a top rock 5' that are substantially similar to the rocks 3 and 5, respectively, as shown and described in conjunction with FIGS. 4–6; and an intermediate rock 3A. In keeping with the modular concept of the invention, the intermediate rock 3A is identical to the bottom rock 3'. The lower surface 27' of the top rock 5' is received in and interfits with the upper surface 9A of the intermediate rock 3A, and the lower surface 7A of the intermediate rock is received in and interfits with the upper surface 9' of the bottom rock 3'. Tongues 37' of the top rock mate with grooves 23A in the intermediate rock. Tongues 46A on the intermediate rock mate with grooves 23' on the bottom rock 3'. The overhanging back end 21A of the intermediate rock is supported by a plate 41' and posts 43' that are substantially similar to the plate 41 and posts 43 of the system 1 of FIGS. 4–6.

The back end 25' of the top rock 5' overhangs the back end 21A of the intermediate rock 3A. To support the back end 25' of the top rock 5', a plate 63, such as plywood, is placed under the top rock back end. The plate 63 in turn is supported on the ground 39' by posts 65. A suitable post 65 is a 55 gallon drum.

The system 55 includes a waterfall. However, it will be appreciated that a system of more than two rocks need not have a waterfall. That is, the system may have the bottom rock module 4 and top rock 6 of the system 2 as shown and described in conjunction with FIGS. 1–3, as well as one or more intermediate rock modules each of which is the same as the bottom rock 4.

In the system 55, a pump 51' is placed in the depression 13' of the bottom rock 3'. A long tube 53' runs from the pump 51', through the slot 19' in the bottom rock, and into the top rock 5'. The tube 53' terminates at a hole 44' in the top rock side wall. Water in the depression 13' is pumped through the tube 53'. The water flows down the top rock channel 35' into a depression 13A in the intermediate rock 3A. Excess water in the depression 13A flows out the channel 17A to the depression 13' in the bottom rock 3'.

It will be understood that more than one intermediate rock 3A can be used between the bottom rock 3' and the top rock 5'. The modular design of the invention assures that the upper surface and lower surface of adjoining rocks interfit, and also that the adjoining rocks interlock by means of the tongue and groove arrangements. Further, if the system includes a waterfall, the modular design assures that the water flows properly between the rocks.

Figures 10, 11:
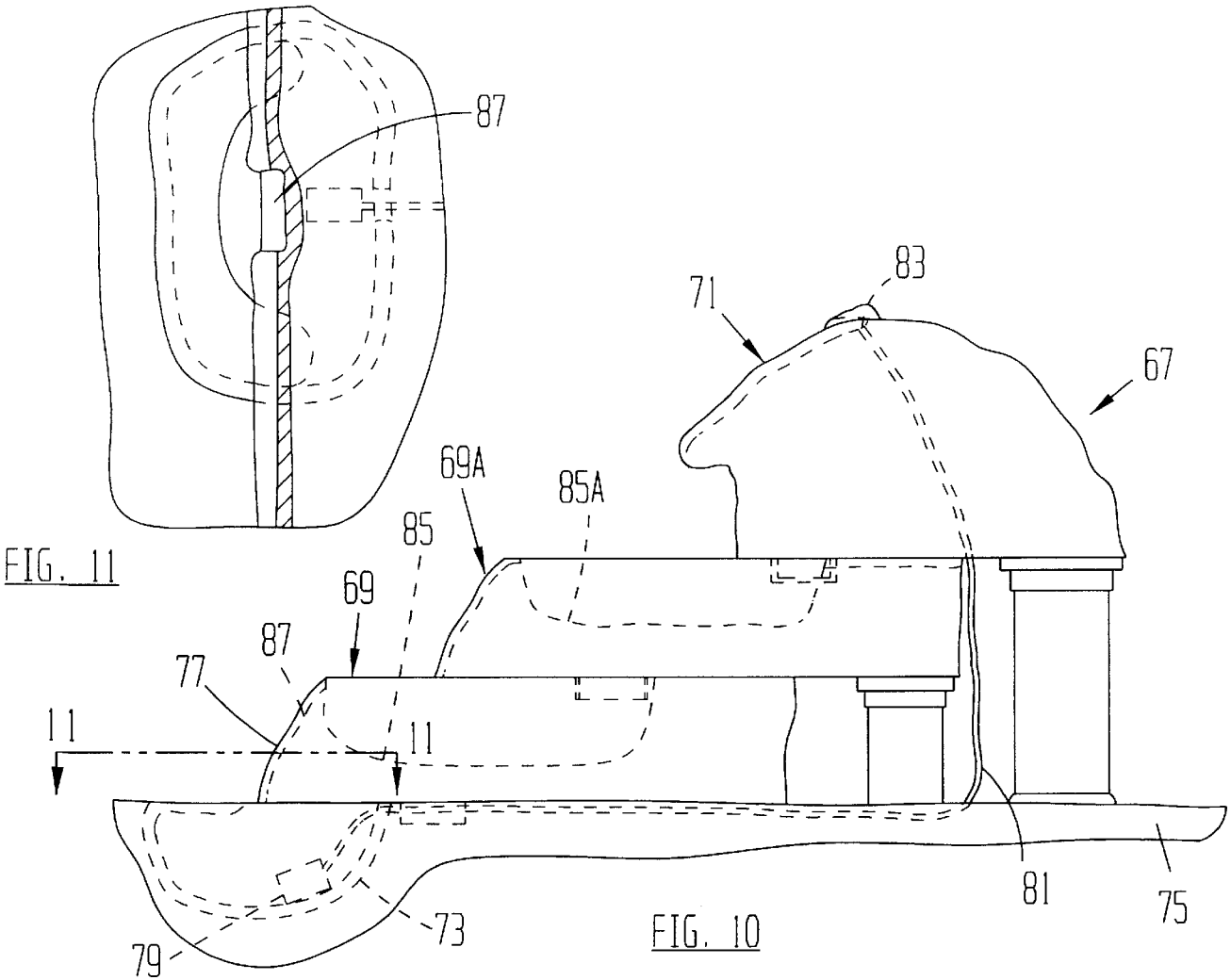
FIG. 10 is a view generally similar to FIG. 7, but showing the water reservoir in the ground.
FIG. 11 is a cross-sectional view taken along line 11—11 of FIG. 10.

According to another aspect of the invention, a separate sump module can be incorporated into the modular rocks. FIGS. 10 and 11 show a system 67 of three stacked rocks 69, 69A, and 71 with a waterfall. A sump module 73 is placed in the ground 75 under the front end 77 of the bottom rock 69. A pump 79 is placed in the sump 73. A tube 81 leads from the pump 79 primarily below the level of the ground 75 to the top rock 71. The tube 81 terminates at a hole 83 at the top of the top rock 71. The sump and the depressions 85 and 85A in the bottom and intermediate rocks 69 and 69A, respectively, are filled with water. Upon operating the pump, the system 67 combines the natural looking rocks with a waterfall in which the overflow from the depression 85 in the bottom rock flows down the channel 87 and disappears into the ground 75.

Figure 13:
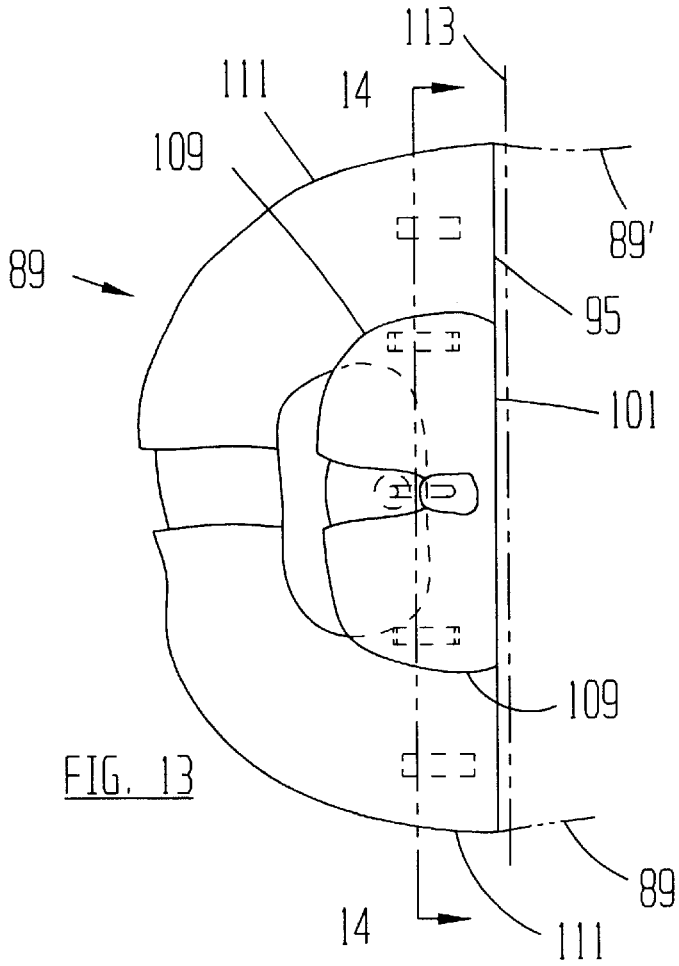
FIG. 13 is a top view of FIG. 12.
Figure 12:
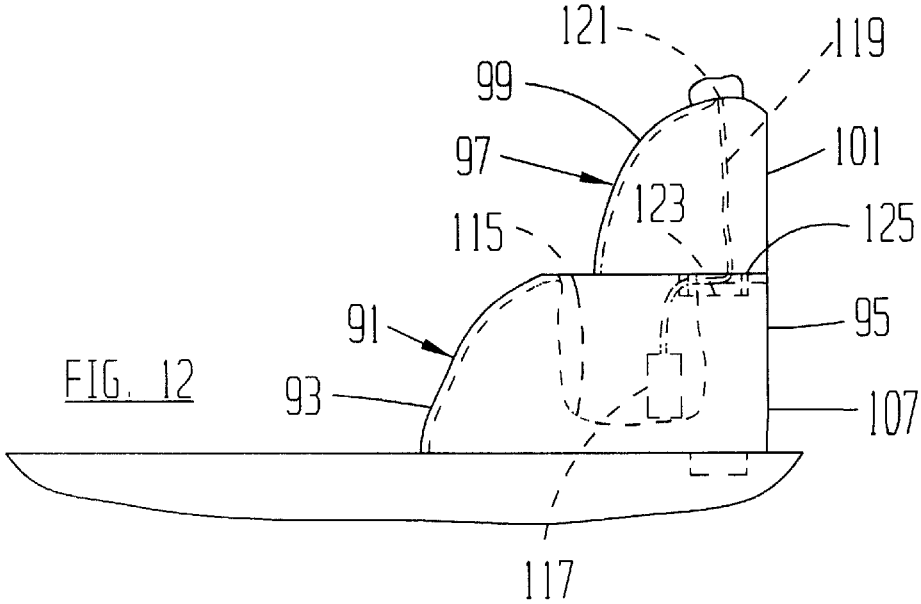
FIG. 12 is a side view of a system of aligned rock modules.
Figure 14:
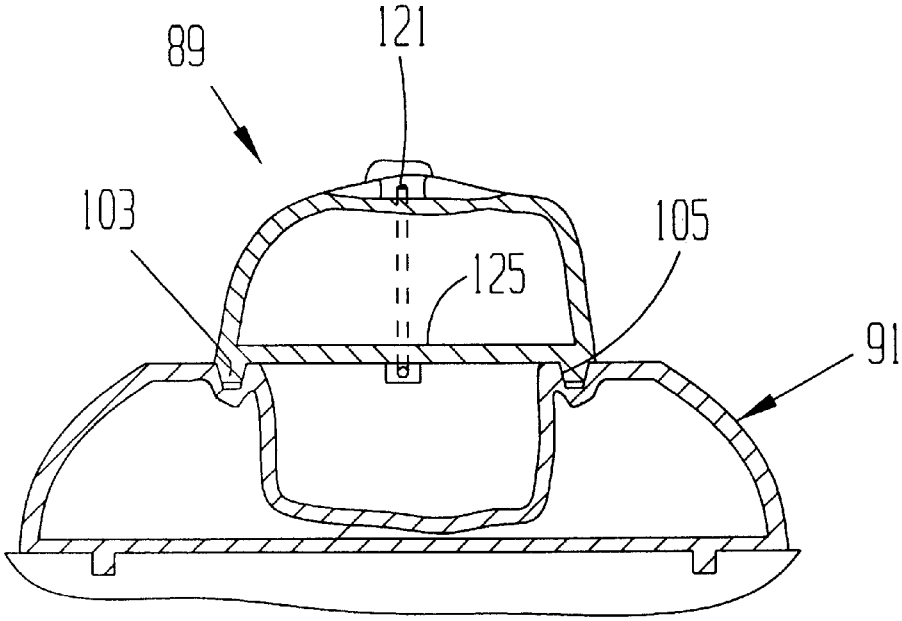
FIG. 14 is a cross-sectional view taken along line 14—14 of FIG. 13 and rotated 90 degrees counterclockwise.

It is an important feature of the invention that the rocks need not be overhanging. FIGS. 12–14 show a system 89 in which the rocks are aligned along their back ends. The system 89 has a bottom rock 91 with a front end 93 and a substantially vertical back end 95. A top rock 97 has a front end 99 and a vertical back end 101. When the top rock 97 is stacked on the bottom rock 91, the upper surface and lower surface of the rocks interfit, and the tongues 103 on the top rock mate with grooves 105 in the bottom rock. Also, the back ends 95 and 101 of the rocks align to form a generally vertical plane 107. As illustrated, the lateral sides 109 of the top rock are substantially inward of the corresponding lateral sides ill of the bottom rock. The system 89 is particularly desirable for using against a wall, building, or fence, schematically illustrated by phantom line 113. However, the system 89 may 10 also be used in duplicate, with the back ends 95 and 101 of each system placed in abutting contact. Phantom lines 89' partially indicate the duplicate of the system 89.

The system 89 is also illustrated as having a waterfall. A depression 115 in the bottom rock 91 is filled with water. A pump 117 in the depression 115 pumps water through a tube 119 to an outlet hole 121 in the top of the top rock 97. The tube 119 is preferably protected in a slot 123 in the upper surface 125 of the bottom rock.

It will be appreciated, of course, that the present invention encompasses a system of aligned rocks similar to the system 89 that does not include a waterfall. Although not depicted in FIGS. 12–14, it will further be appreciated that a sump similar to the sump 73 described in conjunction with FIGS. 10 and 11 can be used with the system 89. In that situation, the pump 117 is placed in the sump instead of in the depression 115 of the bottom rock 91.

Figure 17:
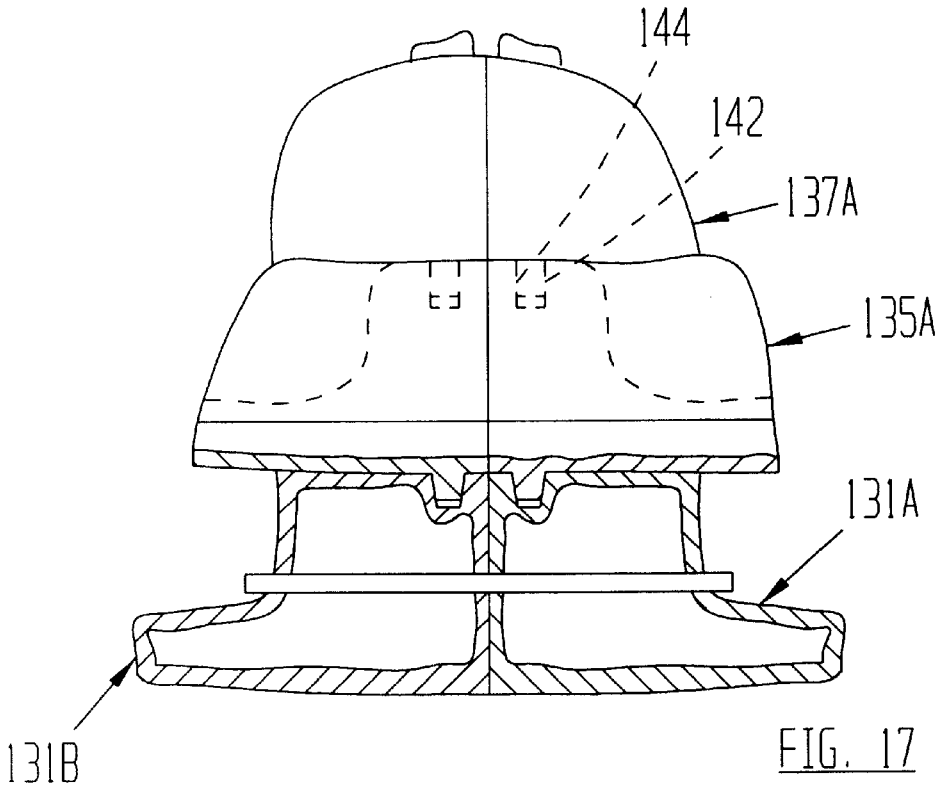
FIG. 17 is a cross-sectional view taken along line 17—17 of FIG. 15.
Figure 15:
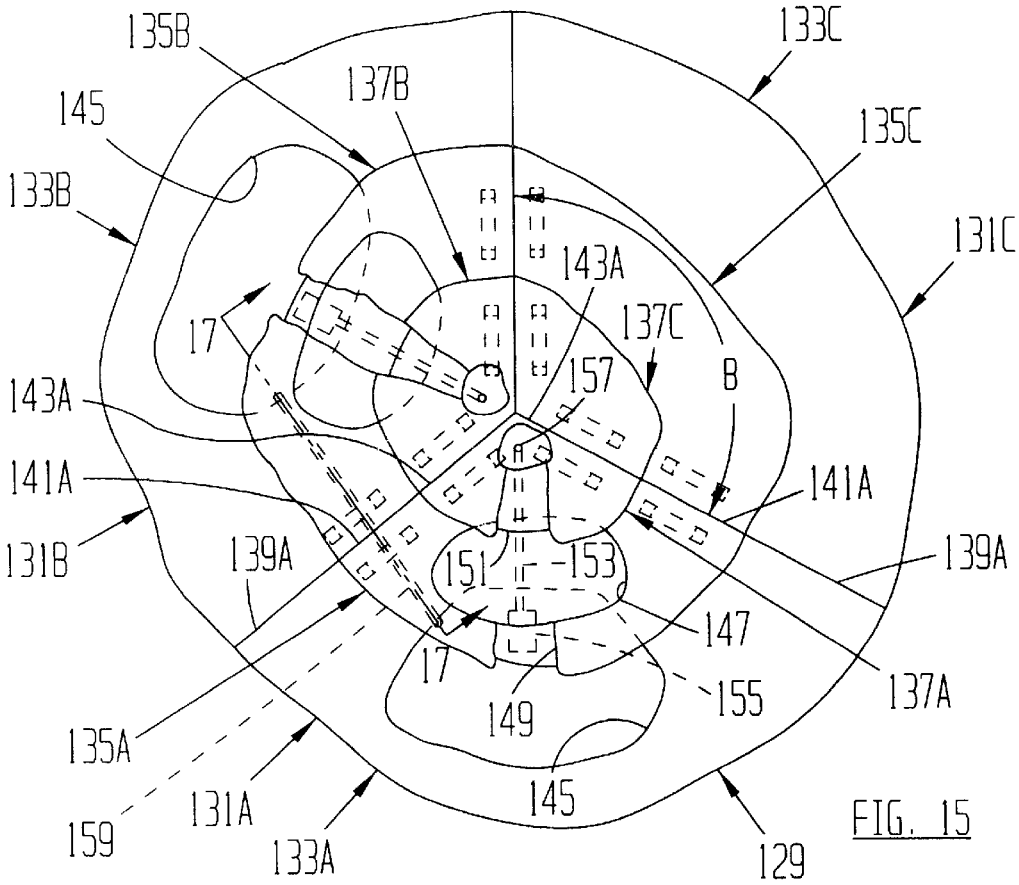
FIG. 15 is a top view of a system containing three stacks of modular rocks according to the present invention.
Figure 16:
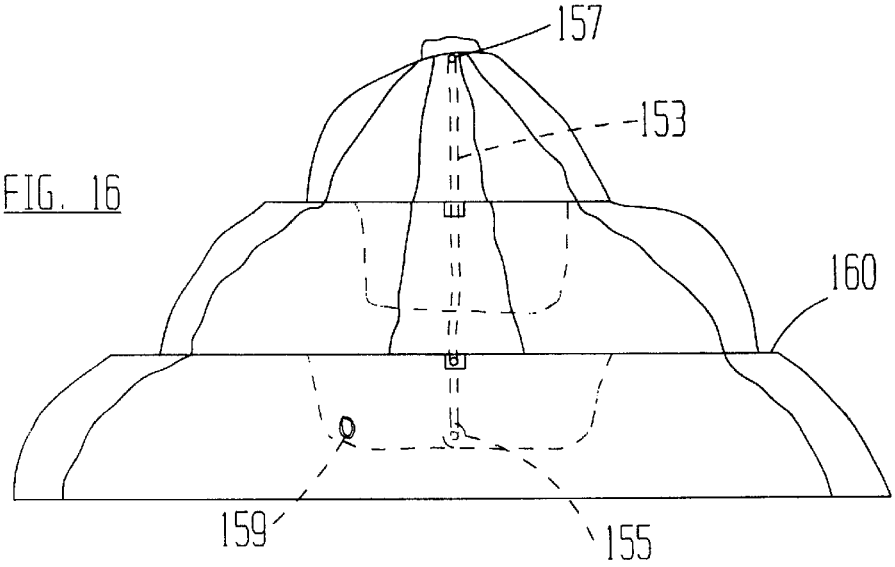
FIG. 16 is a front view of FIG. 15.

The versatility of the present invention is further demonstrated with reference to FIGS. 15–17. Reference numeral 129 indicates a system of modular rocks containing three stacks 131A, 131B, 131C of aligned rocks. The stacks 131A, 131B, 131C have respective bottom rocks 133A, 133B, 133C; intermediate rocks 135A, 135B, 135C; and top rocks 137A, 137B, 137C. The system 129 is distinguished in that each rock has two back ends. For example, the bottom rock 133A of the stack 131A has two back 35 ends 139A. The intermediate rock 135A has two back ends 141A. The top rock 137A has two back ends 143A. The back ends 139A, 141A, 143A align when the rocks 133A, 135A, 137A are stacked on each other.

In the system 129, the angle B subtended by the back ends of each rock, such as back ends 139A of the bottom rock 133A, is 120 degrees. In that situation, bringing the back ends of the stacks into facing contact creates a free standing system of three stacks each containing three modular rocks. The system 129 requires no separate supports. Further, the system 129 presents essentially the same appearance when viewed from anywhere around its perimeter. However, the angle B may be less than 120 degrees. For example, if the angle B is 90 degrees, four stacks of modular rocks can be used to create a free standing system. An angle B of 90 degrees is particularly useful for placing one stack of rocks against an inside corner of a fence or building. If the angle B is 180 degrees, the system 89 of FIGS. 12–14 is produced.

The bottom, intermediate, and top rocks of the system 129 have interfitting upper and lower surfaces between adjoining rocks, and also mating tongues and grooves. For example, the top rock 137A has tongues 142 that mate with grooves 144 in the intermediate rock 135A.

If desired, a system according to the invention can have stacks of only two aligned rocks. For example, the system may have three stacks that use the intermediate rocks 135A, 135B, 135C and the top rocks 137A, 137B, 137C.

A system of aligned rocks, such as system 129, may, but need not, include one or more waterfalls. In the system 129, a waterfall is included in the stacks 131A and 131B, but not in the stack 131C. Looking at the stack 131A, the bottom rock 133A has a depression 14S, and the intermediate rock 135A has a depression 147. There is a shallow channel 149 in the intermediate rock 135A and a similar channel 151 in the top rock 137A. A tube 153 leads from a pump 155 to a hole 157 in the top of the top rock 137A. When a waterfall is incorporated into two or more stacks, it is desirable that a pipe 159 connect the depressions 145 in the bottom rocks. In that way, the same water level and flow will occur in the waterfalls of both stacks.

Although not shown, plant pockets can be formed in any of the top, intermediate, and bottom rocks of the system 129. Also, although the system 129 is shown as being generally round as viewed from above, other shapes are also within the scope of the invention.

In summary, the results and advantages of yard and garden landscapes can now be more fully realized. The modular rock system provides both attractive and natural looking decorative features as well as economy and ease of installation. This desirable result comes from using the combined functions of the interfitting surfaces of the rock modules. Different numbers of rocks can be stacked on top of each other to suit a particular installation requirement. Every pair of adjoining rocks in a stack interlocks by the tongue and groove arrangement. The back ends of overhanging rocks are supported by simple plates and posts readily available to home owners. A stack of aligned rocks can be placed against a building wall or in a corner, or against another stack. The modular nature of the rocks allows great flexibility in their arrangement and placement within a landscape. Waterfalls are includeable in the rock systems to provide even more aesthetic appeal. The waterfalls look exceptionally natural, because the water flows in a closed circuit from a reservoir in the bottom rock to the top of the top rock and then over the natural contours on the outside of the rocks back to the reservoir.

It will also be apparent that in addition to the superior performance and aesthetic appeal of the modular rocks, either with or without waterfalls, their construction is such as to cost no more than traditional decorative rocks and waterfalls. Also, since the modules are relatively light in weight and interchangeable with each other, they can be relocated or rearranged at a scene without major difficulty or expense.

Thus, it is apparent that there has been provided, in accordance with the invention, a system of modular rocks with waterfall that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A method of installing a landscape decoration on the ground comprising the steps of:

a. providing a first modular artificial rock having an upper surface and a lower surface and a side wall with a back end;

b. providing a second modular artificial rock that is substantially identical to the first modular rock and having an upper surface, and a side wall with a top end and a back end;

c. stacking the second rock on the first rock comprising the steps of:

i. overhanging the second rock back end over the first rock back end; and ii. supporting the lower surface of the second rock adjacent the back end thereof off the ground; and d. contacting and interfitting the upper surface of the first rock with the lower surface of the second rock, and simultaneously interlocking the first and second rocks to each other.

2. The method of claim 1 comprising the further steps of:

a. providing a first depression in the first rock upper surface and filling the first depression with water;

b. providing a hole in the second rock near the side wall top end;

c. pumping the water from the first depression to the hole in the second rock; and d. flowing the water down the second rock side wall to the first depression.

3. The method of claim 1 comprising the further steps of:

a. providing a depression in each of the first, third, fifth, and sixth rocks and filling the depressions with water;

b. providing a hole in each of the second and fourth rocks near the respective top ends thereof;

c. pumping the water from the depressions in the fifth and sixth rocks to the holes in the second and fourth rocks, respectively; and d. flowing the water down the second and fourth rocks to the depressions in the first and third rocks, respectively, and further flowing the water from the depressions in the first and third rocks to the depressions in the fifth and sixth rocks, respectively.

4. A system of modular artificial rocks stackable on the ground comprising:

a. a hollow first rock having an upper wall with an upper surface, a lower wall spaced from the upper wall and having a lower surface, and a side wall connecting the upper and lower walls and cooperating therewith to define a substantially enclosed first space therebetween, the side wall having a side surface that connects the upper and lower surfaces, the side wall having a back end, the upper surface being formed with at least one groove therein, the lower surface having at least one tongue depending therefrom;

b. a hollow second rock having a lower wall with a lower surface, and a side wall upstanding from the lower wall and having a top end and a back end, the lower and side walls cooperating to define a substantially enclosed second space, the second rock being stacked on the first rock with a substantial portion of the second rock lower surface in contact and interfitting with the first rock upper surface, the second rock having at least one tongue in the lower surface that mates with said at least one groove in the first rock to thereby interlock the first and second rocks; and c. a third rock having a lower wall with a lower surface, an upper wall spaced from the lower wall and having an upper surface, and a side wall connecting the lower and upper walls and cooperating therewith to define a substantially enclosed third space, the side wall having a back end, the third rock upper surface being formed with at least one groove therein, the third rock being stacked beneath the first rock with a substantial portion of the first rock lower surface in contact and interfitting with the third rock upper surface, and with said at least one tongue in the first rock mating with said at least one groove in the third rock to thereby interlock the first and third rocks, wherein:

i. the first and third rocks have respective depressions therein that are filled with water;

ii. the second rock has a hole therethrough proximate the top end of the side wall; and iii. the system of modular rocks further comprises means for pumping the water from the third rock depression to the hole in the second rock, the water flowing from the hole in the second rock down the second rock side wall to the depression in the first rock, the water further flowing from the depression in the first rock to the depression in the third rock.

5. A system of modular artificial rocks stackable on the ground comprising:

a. a hollow first rock having an upper wall with an upper surface, a lower wall spaced from the upper wall and having a lower surface, and a side wall connecting the upper and lower walls and cooperating therewith to define a substantially enclosed first space therebetween, the side wall having a side surface that connects the upper and lower surfaces, the side wall having a back end, the upper surface being formed with at least one groove therein, the lower surface having at least one tongue depending therefrom;

b. a hollow second rock having a lower wall with a lower surface, and a side wall upstanding from the lower wall and having a top end and a back end, the lower and side walls cooperating to define a substantially enclosed second space, the second rock being stacked on the first rock with a substantial portion of the second rock lower surface in contact and interfitting with the first rock upper surface, the second rock having at least one tongue in the lower surface that mates with said at least one groove in the first rock to thereby interlock the first and second rocks; and c. a third rock having a lower wall with a lower surface, an upper wall spaced from the lower wall and having an upper surface, and a side wall connecting the lower and upper walls and cooperating therewith to define a substantially enclosed third space, the side wall having a back end, the third rock upper surface being formed with at least one groove therein, the third rock being stacked beneath the first rock with a substantial portion of the first rock lower surface in contact and interfitting with the third rock upper surface, and with said at least one tongue in the first rock mating with said at least one groove in the third rock to thereby interlock the first and third rocks, wherein:

i. the first and third rocks have respective depressions therein that are filled with water;

ii. the second rock has a hole therethrough proximate the top end of the side wall; and iii. the system of modular rocks further comprises:

a sump in the ground filled with water; and means for pumping the water from the sump to the hole in the second rock, the water flowing from the hole in the second rock down the second rock side wall and into the depression in the first rock, the water further flowing from the depression in the first rock to the depression in the third rock, the water further flowing from the depression in the third rock to the sump.

6. A method of installing a landscape decoration on the ground comprising the steps of:

a. providing a first modular artificial rock having an upper surface and a lower surface and a side wall with a back end;

b. providing a second modular artificial rock having an upper surface, and a side wall with a top end and a back end;

c. stacking the second rock on the first rock;

d. contacting and interfitting the upper surface of the first rock with the lower surface of the second rock, and simultaneously interlocking the first and second rocks to each other;

e. providing a third modular artificial rock having an upper surface and a lower surface;

f. stacking the first rock on the third rock;

g. contacting and interfitting the third rock upper surface with the first rock lower surface, and simultaneously interlocking the first and third rocks to each other;

h. providing a first depression in the third rock upper surface and filling the first depression with water;

i. providing a second depression in the first rock and filling the second depression with water;

j. providing a hole in the top rock near the side wall top end;

k. pumping the water from the first depression to the hole in the second rock; and l. flowing the water down the second rock side wall to the second depression, and flowing the water from the second depression to the first depression.

7. A system of modular artificial rocks stackable on the ground comprising:

a. a hollow first rock having an upper wall with an upper surface, a lower wall spaced from the upper wall and having a lower surface, and a side wall connecting the upper and lower walls and cooperating therewith to define a substantially enclosed first space therebetween, the side wall having a side surface that connects the upper and lower surfaces, the side wall having a back end, the upper surface being formed with at least one groove therein, the lower surface having at least one tongue depending therefrom; and b. a hollow second rock having a lower wall with a lower surface, and a side wall upstanding from the lower wall and having a top end and a back end, the lower and side walls cooperating to define a substantially enclosed second space, the second rock being stacked on the first rock with a substantial portion of the second rock lower surface in contact and interfitting with the first rock upper surface, the second rock having at least one tongue in the lower surface that mates with said at least one groove in the first rock to thereby interlock the first and second rocks, wherein the back ends of the first and second rocks are each generally flat and are aligned with each other in a substantially vertical plane, and wherein:

i. the first rock has a depression in the upper surface thereof that contains water;

ii. the second rock has a hole therethrough proximate the top end of the side wall; and iii. the system of modular rocks further comprises means for pumping the water from the first rock depression to the hole in the second rock, the water flowing from the hole in the second rock down the second rock side wall and to the depression in the first rock.

8. A method of installing a landscape decoration on the ground comprising the steps of:

a. providing a first modular artificial rock having an upper surface and a lower surface and a side wall with a first substantially flat and vertical back end;

b. providing a second modular artificial rock having an upper surface, and a side wall with a top end and a second substantially flat and vertical back end;

c. stacking the second rock on the first rock comprising the step of vertically aligning the second rock back end with the first rock back end;

d. contacting the interfitting the upper surface of the first rock with the lower surface of the second rock, and simultaneously interlocking the first and second rocks to each other;

e. providing a first depression in the first rock upper surface and filling the first depression with water;

f. providing a hole in the second rock near the side wall top end;

g. pumping the water from the first depression to the hole in the second rock; and h. flowing the water down the second rock side wall to the first depression.

9. A method of installing a landscape decoration on the ground comprising the steps of:

a. providing a first modular artificial rock having an upper surface and a lower surface and a side wall with a back end;

b. providing a second modular artificial rock having an upper surface, and a side wall with a top end and a back end;

c. stacking the second rock on the first rock comprising the steps of:

i. overhanging the second rock back end over the first rock back end; and ii. supporting the lower surface of the second rock adjacent the back end thereof off the ground; and d. contacting and interfitting the upper surface of the first rock with the lower surface of the second rock, and simultaneously interlocking the first and second rocks to each other.

10. Decorative apparatus for a landscape comprising:

a. a first modular artificial rock having an upper surface and a lower surface, and a side wall between the upper and lower surfaces that has a substantially flat vertical back end; and b. a second modular artificial rock having a lower surface, and a side wall upstanding from the lower surface and having a top end, the second rock having a back end that is substantially flat and vertical, the second rock being stacked on the first rock with the second rock lower surface interfitting with the first rock upper surface, the back end of the second rock being substantially coplanar with the back end of the first rock, wherein:

i. the first rock has a depression in the upper surface thereof that is filled with water;

ii. the second rock side wall has a hole proximate the top end thereof; and iii. a pump in the first depression pumps water therefrom to the hole in the second rock, the water flowing down the second rock to the first rock depression.

11. Modular rocks comprising:

a. first, second, and third hollow rocks each having a lower surface and an upper surface and each having first and second substantially flat vertical back ends; and b. fourth, fifth, and sixth hollow rocks each having a lower surface and a side wall upstanding from the lower surface and having a top end, each fourth, fifth, and sixth rock having first and second substantially flat vertical back ends, the fourth, fifth, and sixth rocks being stacked on the first, second, and third rocks, respectively, the lower surfaces of the fourth, fifth, and sixth rocks interfitting with the upper surfaces of the first, second, and third rocks, respectively, the first and second back ends of the first and fourth, second and fifth, and third and sixth rocks, respectively, being aligned vertically, the first back end of the first rock being in facing contact with the second back end of the second rock, and the second back end of the first rock being in facing contact with the first back end of the third rock, wherein:

i. the first rock has a depression in the upper surface thereof that is filled with water;

ii. the fourth rock side wall has a hole proximate the top end thereof; and iii. a pump in the first rock depression pumps water therefrom to the hole in the fourth rock, the water flowing down the fourth rock to the first rock depression, so that the system of modular rocks is free standing.

12. A system of modular artificial rocks stackable on the ground comprising:

a. a hollow first rock having an upper wall with an upper surface, a lower wall spaced from the upper wall and having a lower surface, and a side wall connecting the upper and lower walls and cooperating therewith to define a substantially enclosed first space therebetween, the side wall having a side surface that connects the upper and lower surfaces, the side wall having a back end, the upper surface being formed with at least one groove therein, the lower surface having at least one tongue depending therefrom;

b. a hollow second rock having a lower wall with a lower surface, and a side wall upstanding from the lower wall and having a top end and a back end, the lower and side walls cooperating to define a substantially enclosed second space, the second rock being stacked on the first rock with a substantial portion of the second rock lower surface in contact and interfitting with the first rock upper surface, the second rock having at least one tongue in the lower surface that mates with said at least one groove in the first rock to thereby interlock the first and second rocks; and c. a third rock having a lower wall with a lower surface, an upper wall spaced from the lower wall and having an upper surface, and a side wall connecting the lower and upper walls and cooperating therewith to define a substantially enclosed third space, the side wall having a generally flat back end between the upper and lower surfaces, the third rock upper surface having at least one groove therein, the third rock being stacked beneath the first rock with the first rock lower surface in contact and interfitting with the third rock upper surface, and with said at least one tongue in the first rock mating with said at least one groove in the third rock to thereby interlock the first and third rocks to each other, the third rock back end being substantially aligned in a vertical plane with the back ends of the first and second rocks, wherein:

i. the first and third rocks have respective depressions therein that are filled with water;

ii. the second rock has a hole therethrough proximate the top end of the side wall; and iii. the system of modular rocks further comprises means for pumping the water from the third rock depression to the hole in the second rock, the water flowing from the hole in the second rock down the second rock side wall to the depression in the first rock, the water further flowing from the depression in the first rock to the depression in the third rock.

13. A system of modular artificial rocks stackable on the ground comprising:

a. a hollow first rock having an upper surface, a lower surface, and a side wall connecting the upper and lower surfaces, the side wall including a back end;

b. a hollow second rock having a lower surface that is interfittable with the first rock upper surface, and a side wall upstanding from the lower surface and having a top end, the second rock side wall defining a back end, the second rock being stacked on the first rock with the second rock lower surface interfitting with the first rock upper surface and the second rock back end overhanging the first rock back end; and c. first support means for supporting the lower surface of the second rock adjacent the back end thereof off the ground.

14. The system of claim 13 further comprising:

a. a third rock having a lower surface, an upper surface that is interfittable with the first rock lower surface, and a side wall with a back end, the third rock being stacked beneath the first rock with the first rock lower surface interfitting with the third rock upper surface, and with the first rock back end overhanging the third rock back end; and b. second support means for supporting the lower surface of the first rock adjacent the back end thereof off the ground.

15. The system of claim 13 wherein the first support means comprises:

a. a plate under the lower surface of the second rock adjacent the back end thereof; and b. at least one post between the plate and the ground.

16. The system of claim 13 wherein:

a. the first rock has a depression in the upper surface thereof that contains water;

b. the second rock has a hole therethrough proximate the top end of the side wall; and c. the system of modular rocks further comprises means for pumping the water from the first rock depression to the hole in the second rock, the water flowing from the hole in the second rock down the second rock side wall and to the depression in the first rock.

17. The system of claim 13 wherein:

a. the first rock has a depression in the upper surface thereof that contains water;

b. the second rock has a hole therethrough proximate the top end of the side wall; and c. the system of modular rocks further comprises:

i. a sump in the ground filled with water; and ii. means for pumping the water from the sump to the hole in the second rock, the water flowing from the hole in the second rock down the second rock side wall and into the depression in the first rock, the water further flowing from the depression in the first rock into the sump.

18. The system of claim 14 wherein the first and third rocks are substantially identical.

19. The system of claim 14 wherein:

a. the first and third rocks have respective depressions therein that are filled with water;

b. the second rock has a hole therethrough proximate the top end of the side wall; and c. the system of modular rocks further comprises means for pumping the water from the third rock depression to the hole in the second rock, the water flowing from the hole in the second rock down the second rock side wall to the depression in the first rock, the water further flowing from the depression in the first rock to the depression in the third rock.

20. A system of modular rocks comprising:

a. a hollow first rock having upper and lower surfaces and a side wall between the upper and lower surfaces that has first and second back ends that define respective generally flat vertical planes; and b. a hollow second rock having a lower surface that is interfittable with the first rock upper surface, and a side wall upstanding from the lower surface that has first and second back ends that define respective generally flat vertical planes, the second rock being stacked on the first rock with the second rock lower surface interfitting with the first rock upper surface, the planes of the first rock first and second back ends being substantially coplanar with the planes of the second rock first and second back ends, respectively, wherein:

i. the first rock has a depression in the upper surface thereof that contains water;

ii. the second rock has a hole therethrough proximate the top end of the side wall; and iii. the system further comprises means for pumping the water from the first rock depression to the hole in the second rock, the water flowing from the hole in the second rock down the second rock side wall and to the depression in the first rock.

* * * * *